US006619002B2

(12) United States Patent
Pettit

(10) Patent No.: US 6,619,002 B2
(45) Date of Patent: Sep. 16, 2003

(54) DECK STRUCTURE

(76) Inventor: Frederick M. Pettit, 2111 Merrittville Hwy., Fonthill, Ontario (CA), L0S 1E6

( * ) Notice: Subject to any disclaimer, the term of this patent is extended or adjusted under 35 U.S.C. 154(b) by 27 days.

(21) Appl. No.: 09/813,612

(22) Filed: Mar. 21, 2001

(65) Prior Publication Data

US 2002/0178677 A1 Dec. 5, 2002

(51) Int. Cl.[7] ..... E04F 11/16

(52) U.S. Cl. ..... 52/177; 52/263; 52/489.1; 52/506.1; 52/591.4; 52/650.3; 52/392; 114/267; 114/366; 405/218

(58) Field of Search ..... 52/177, 489.1, 52/588.1, 263, 591.4, 592.1, 506.1, 506.08, 506.09, 483.1, 650.3, 384, 390, 392; 403/218–220; 114/267, 366

(56) References Cited

U.S. PATENT DOCUMENTS 5,048,448 A * 9/1991 Yoder ..... 114/263
5,215,802 A * 6/1993 Kaars Sijpesteijn ..... 428/100
5,228,253 A * 7/1993 Wattelez ..... 52/177
5,351,458 A * 10/1994 Lehe ..... 52/586.2
5,527,128 A * 6/1996 Rope et al. ..... 404/35
5,613,339 A * 3/1997 Pollock ..... 52/731.1
5,660,016 A * 8/1997 Erwin et al. ..... 52/483.1
5,758,467 A * 6/1998 Snear et al. ..... 52/592.1
5,950,377 A * 9/1999 Yoder ..... 52/177
6,044,598 A * 4/2000 Elsasser et al. ..... 52/181
6,233,886 B1 * 5/2001 Andres ..... 52/177
6,314,699 B1 * 11/2001 West ..... 52/489.1
6,324,796 B1 * 12/2001 Heath ..... 52/177

* cited by examiner

*Primary Examiner*—Carl D. Friedman
*Assistant Examiner*—Yvonne M. Horton
(74) *Attorney, Agent, or Firm*—Joseph P. Gastel

(57) ABSTRACT

A flooring system including resin channels having webs and legs mounted on joists with their webs resting on the edges of the joists and their legs straddling the sides of the joists, and a plurality of adjacent resin tiles each having a plate with inner flanges extending downwardly from the plate with slots in the inner flanges receiving pins on the legs of the channels, and outer flanges located outwardly of the inner flanges which rest on the webs of the channels.

59 Claims, 5 Drawing Sheets

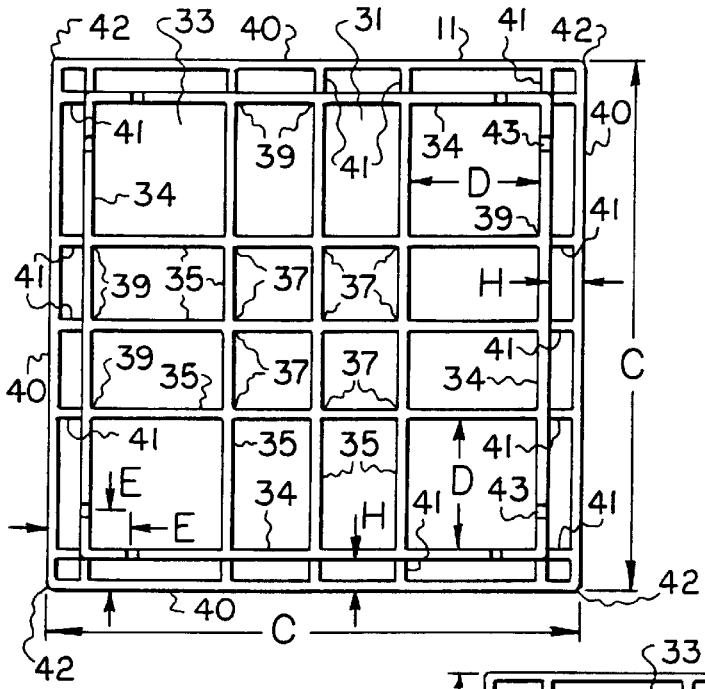
FIG. 2
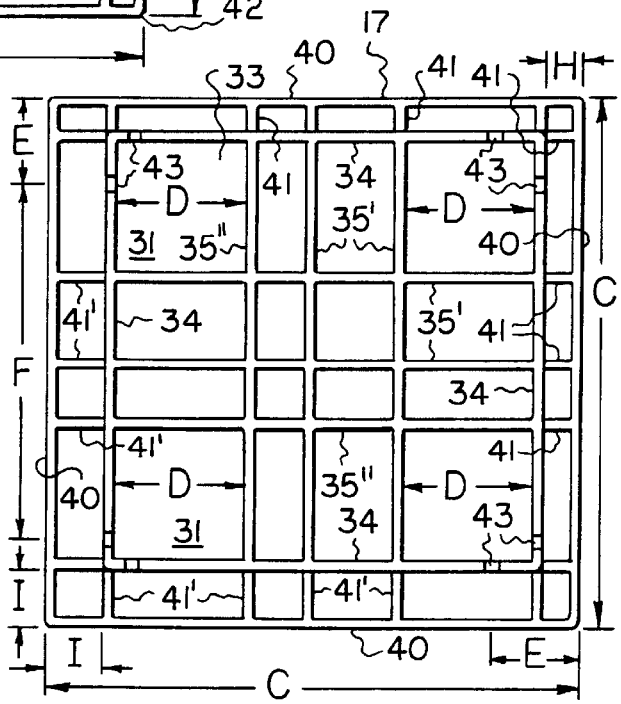
FIG. 3
FIG. 9
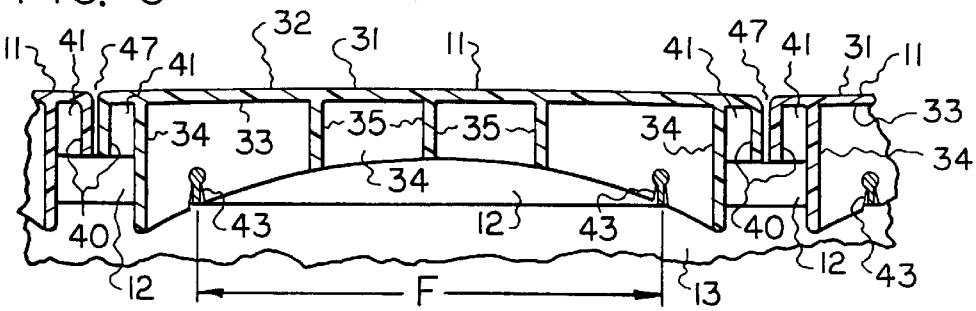

FIG. 10
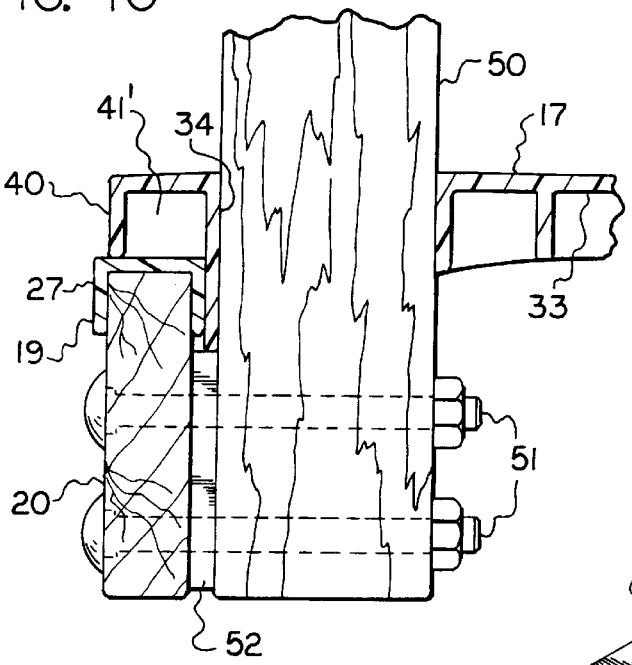
FIG. 12
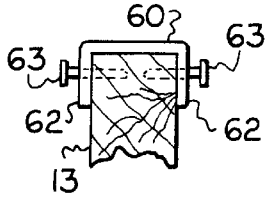
FIG. 14
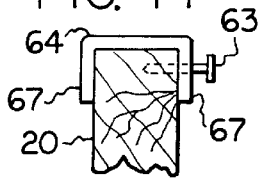
FIG. 11
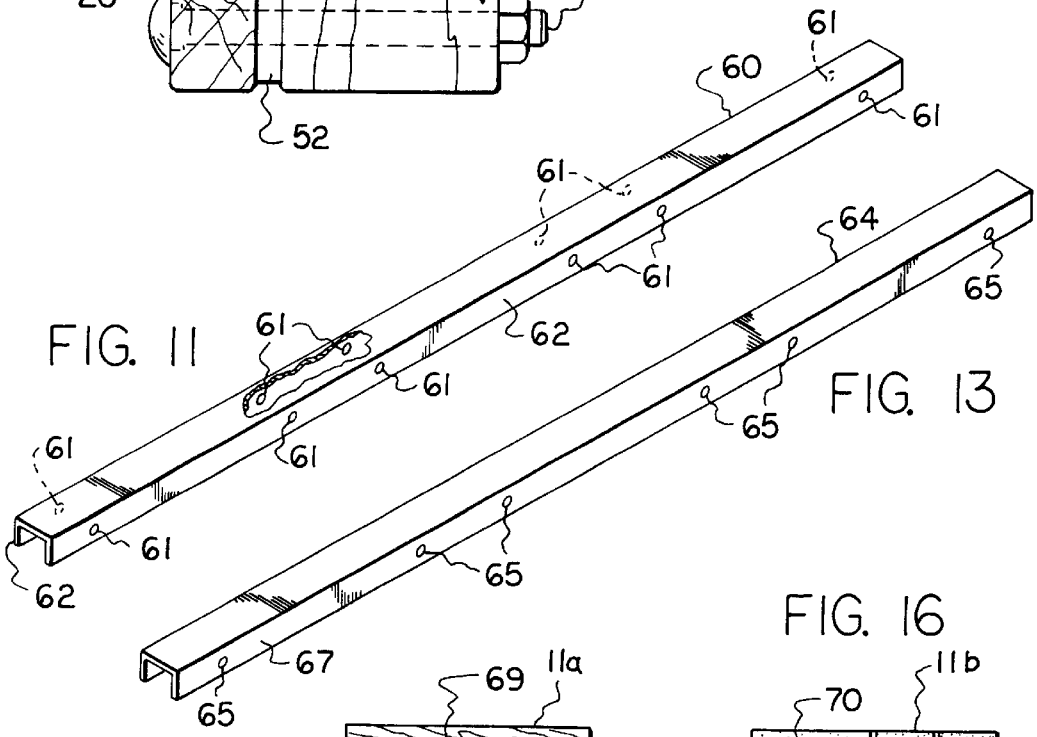
FIG. 13
FIG. 16
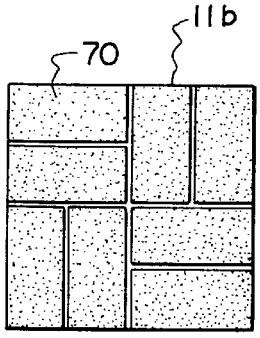
FIG. 15
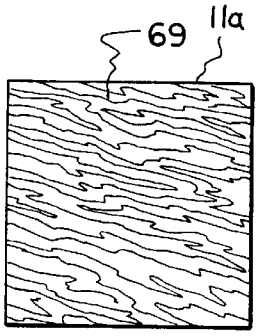

DECK STRUCTURE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention relates to a flooring system which is especially directed to outdoor types of decks which are subject to the elements.

It is believed that there is no single deck system in existence which has all the features of the present deck structure as enumerated hereafter.

BRIEF SUMMARY OF THE INVENTION

It is one object of the present invention to provide a flooring system, especially for outdoor use, which will not warp, twist or be subject to insect attack and which does not require any maintenance.

Another object of the present invention is to provide a flooring system which is easily installed because the main portion of the deck structure simply snaps into place without requiring measuring or cutting and which totally finishes the deck without the need for trim or flashing.

A further object of the present invention is to provide a flooring system which inherently includes spacings between tiles which not only allow for expansion and contraction but also provides for water drainage, thereby eliminating puddles.

Yet another object of the present invention is to provide a flooring system which not only can be installed without use of exposed fasteners but also preserves wooden floor joists by preventing water from laying on the top of the joist which could produce rot.

A still further object of the present invention is to provide a flooring system consisting only of four major components which are of relatively small dimensions so that the system can easily be transported in relatively small packages, thereby enhancing the ease and economy of transporting it from the manufacturer to the ultimate consumer.

A still further object of the present invention is to provide a flooring system which utilizes modular tiles which can easily be replaced if they are damaged. Other objects and attendant advantages of the present invention will readily be perceived hereafter.

The present invention relates to a plastic tile comprising a plate, upper and lower surfaces on said plate, a plurality of inner side members positioned below said lower surface of said plate, a plurality of ribs extending downwardly from said lower surface, outer edges on said ribs molded integrally with said inner side members, and outer side members extending downwardly from said plate and located outwardly of said inner side members.

The present invention also relates to a tile assembly including a plurality of tiles as set forth above including a plurality of channel members positioned alongside certain of said inner side members and secured thereto with said outer side members resting on said channel members.

The present invention will be more fully understood when the following portions of the specification are read in conjunction with the accompanying drawings wherein:

BRIEF DESCRIPTION OF THE SEVERAL VIEWS OF THE DRAWING

FIG. 2 is a bottom plan view of a molded plastic inner tile which is located within the edge tiles secured to the joists;

FIG. 3 is a bottom plan view of an outer edge tile which is to be secured along the outer edges of the deck;

FIG. 9 is a fragmentary cross sectional view taken substantially along line 9—9 of FIG. 8 and showing the edge channels which are mounted on the edge joist;

FIG. 10 is an enlarged fragmentary cross sectional view showing a post mounted on the deck and secured to a joist;

FIG. 11 is a perspective view partially broken away of an alternate type of inner channel;

FIG. 12 is an end elevational view of the inner channel of FIG. 11 secured to a fragmentary representation of an inner joist;

FIG. 13 is a perspective view of an alternate type of edge channel;

FIG. 14 is an end elevational view of the edge channel of FIG. 13 mounted on a fragmentary representation of an edge joist;

FIG. 15 is a view of the upper surface of a tile having a specific type of nonskid configuration;

FIG. 16 is a view of the upper surface of a tile having still another type of configuration.

DETAILED DESCRIPTION OF THE INVENTION

Figure 1:
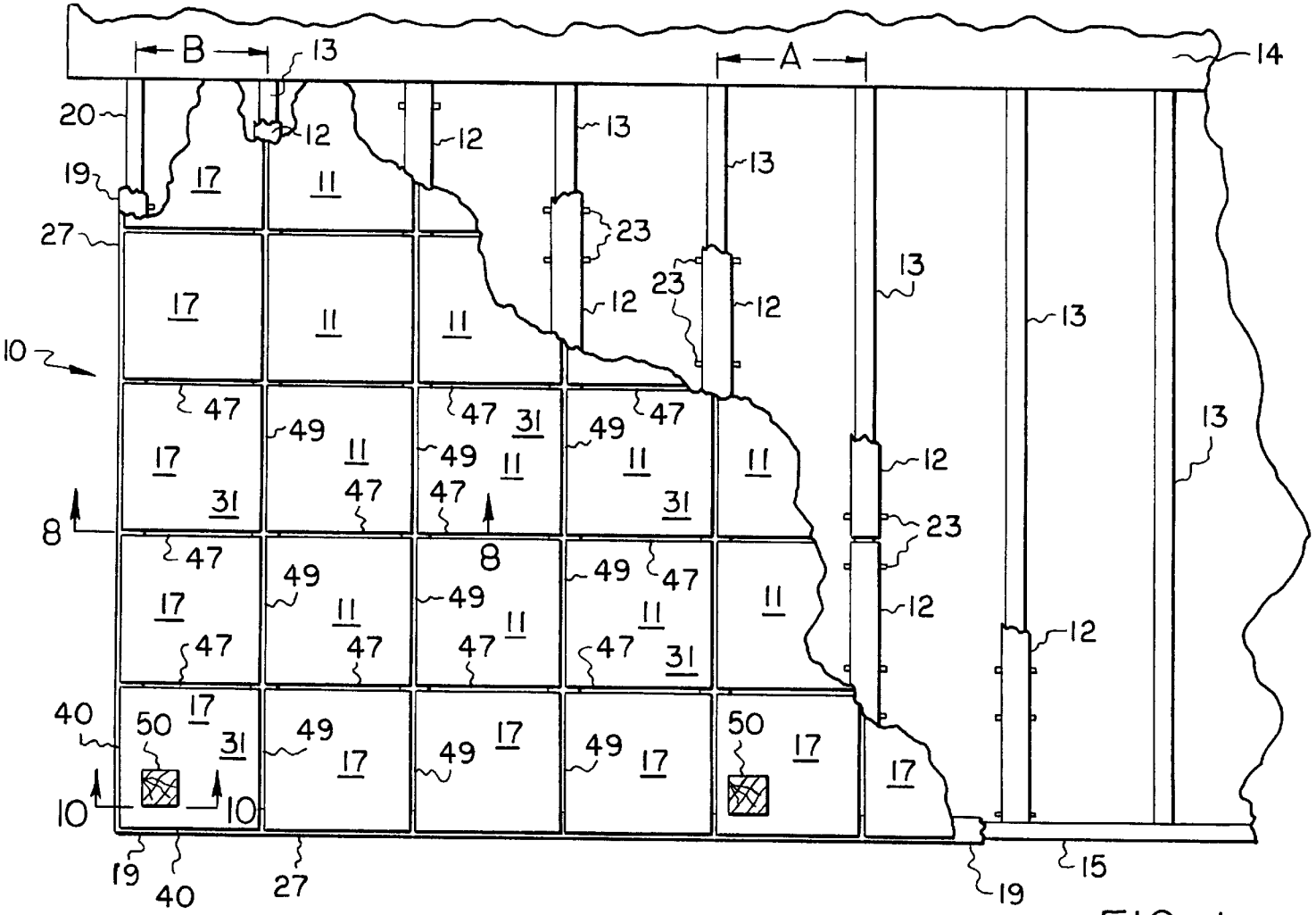
FIG. 1 is a fragmentary plan view, partially in cross section, showing the improved floor tile system installed as a deck on joists which extend outwardly from a structure such as a house.

The deck structure 10 of the present invention includes a plurality of resin inner tiles 11 which are secured to inner channels 12 mounted on joists 13 which extend between a structure, such as house 14 and facia joist 15. A first series of resin edge tiles 17 are mounted between a plurality of end-to-end inner channels 12 mounted on an inner joist 13 and a plurality of end-to-end edge channels 19 which are mounted on edge joist 20. A second series of resin edge tiles 17 are mounted between ends of inner channels 12 and a plurality of end-to-end edge channels 19 mounted on facia joist 15.

The inner channels 12 (FIGS. 4, 6 and 7) are each fabricated of molded resin having a web 21 and legs 22. Pins 23 are molded integrally with legs 22, and a support rib or gusset 24 is molded integrally with each of the pins 23 and the portion of adjacent leg 22. As can be seen from FIGS. 4 and 6, the pins 23 extend outwardly from both legs 22. The edge channel 19 is also fabricated of molded resin, and it consists of a web 25 with depending legs 27. Edge channel 19 includes spaced pins 29 which extend outwardly from only one leg 27 thereof. A support rib or gusset 30, which is molded integrally with each pin 29 and leg 27, is located below each pin 29. Each rib 30 has the same configuration as rib 24 of FIGS. 6 and 7.

Channels 12 and 19 are secured to joists 13 and 20 by nails or screws which pass through the webs 21 and 25 at appropriate intervals, such as every foot, and are received in the respective joists. As will become apparent hereafter, the nails or screws are the only metal fasteners which are used in the floor system and they are not exposed because they are hidden by the tiles 11 and 17 which are mounted on the channels. Also, since the channels 12 and 19 are essentially caps for the wooden joists, they tend to preserve them by preventing water from laying on the tops of the joists which causes rot. The use of resin for the tiles and channels provides a flooring system that does not require maintenance, will not warp and is not subject to insect attack.

Figures 4, 5, 5A, 6, 7, 8, 8A:
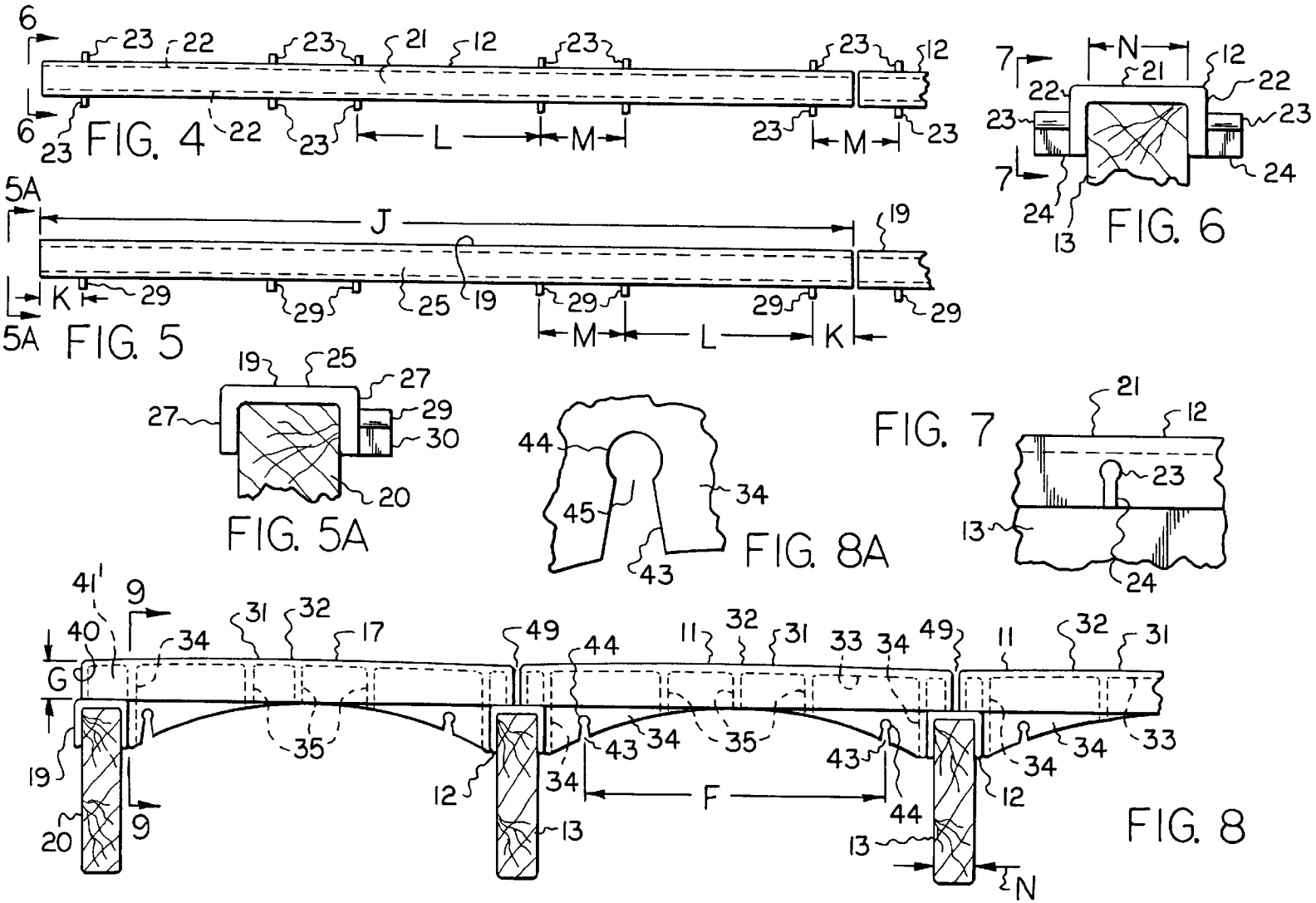
FIG. 4 is a fragmentary plan view of inner channels which are to be mounted on the inner joists of a deck with the inner channels in end-to-end relationship.
FIG. 5 is a fragmentary plan view of edge channels which are to be mounted on the edge joists of a deck with the edge channels in end-to-end relationship.
FIG. 5A is an elevational view of an edge channel taken substantially in the direction of arrows 5A—5A of FIG. 5 and showing the edge channel mounted on a fragmentary representation of a joist.
FIG. 6 is an end elevational view of an inner channel taken substantially in the direction of arrows 6—6 of FIG. 4 with said channel mounted on a fragmentary representation of a joist.
FIG. 7 is a fragmentary side elevational view taken in the direction of arrows 7—7 of FIG. 6 and showing the structure of the pins which extend outwardly from the leg of the channel.
FIG. 8 is a fragmentary cross sectional view taken substantially along line 8—8 of FIG. 1 and showing the edge tiles and inner tiles mounted on the inner and edge channels, respectively, mounted on the joists.
FIG. 8A is a fragmentary enlarged section of a side member of a tile showing the slot structure for receiving the pins of the channels.

The inner tiles 11 (FIGS. 1, 2, 8 and 9) each include a plate 31 having an upper surface 32 and a lower surface 33. Upper surface 32 is formed with a suitable tread to tend to prevent people slipping thereon. A plurality of identical inner side members or inner flanges 34 are molded integrally with and extend downwardly from lower surface 33 of plate 31 (FIGS. 2, 8 and 9). Central ribs 35 (FIGS. 2, 8 and 9) extend between opposite pairs of inner side members 34. Additionally, central portions of ribs 35 are located in a crossover pattern (FIG. 2) and are molded to each other at intersections 37 in addition to being molded integrally at their outer ends with side members 34 at 39. The upper edges of ribs 35 are molded integrally with the lower surface 33 of plate 31. Thus, ribs 35 rigidize both upper plate 31 and side members 34.

Outer side members or outer flanges 40 (FIGS. 2 and 9) extend downwardly from plate 31 at the outer edges thereof and are molded integrally therewith. They are also molded integrally with each other at their adjacent ends 42. Ribs 41 are molded integrally with the lower surface 33 of plate 31 and they are molded integrally with and extend between outer side members 40 and side members 34 to thereby rigidize them. As can be seen from FIG. 9, inner flanges 34 have a greater vertical height than outer flanges 40, and outer side members 40 rest on the tops of channels 12 when tiles 11 are in their installed position.

The inner tiles 11 are installed in the following manner. It is merely necessary to align slots 43 in side members 34 with pins 23 which extend outwardly from inner channels 12. Thereafter, it is only necessary to bear downwardly on the edges of the tile until the pins 23 enter slots 43 (FIG. 8A) and come to rest in the ends 44 of slots 43. The neck 45 of each slot 43 is slightly smaller than the diameter of the pins 23 which it receives. Therefore, the edges of slot portion 45 will deflect slightly as each pin 23 enters slot portion 44, and thereafter they will snap back into their unstressed position to thereby essentially lock side members 34 against moving upwardly out of engagement with pins 23. Thus, it can readily be seen that tools are not required to assemble tiles 11 onto channels 12. When the tiles 11 are fully installed, they will be firmly supported on joists 13 because of the above locking of pins 23 in slots 34 and further because outer side members 40 rest on channels 12. The pin and slot connections 23, 43 are merely to properly locate the tile 11 relative to the channels 12 and retain the tiles in position; the loading on the tiles is borne by the outer flanges 40 bearing on the channels 12. It will be appreciated that other structure can be substituted for the pin and slot 23, 43 connections, such as protrusions and dimples. If it becomes necessary to remove a tile for replacement, it is merely necessary to force it upwardly so that the pins 23 will be released from slots 43.

Figure 17:
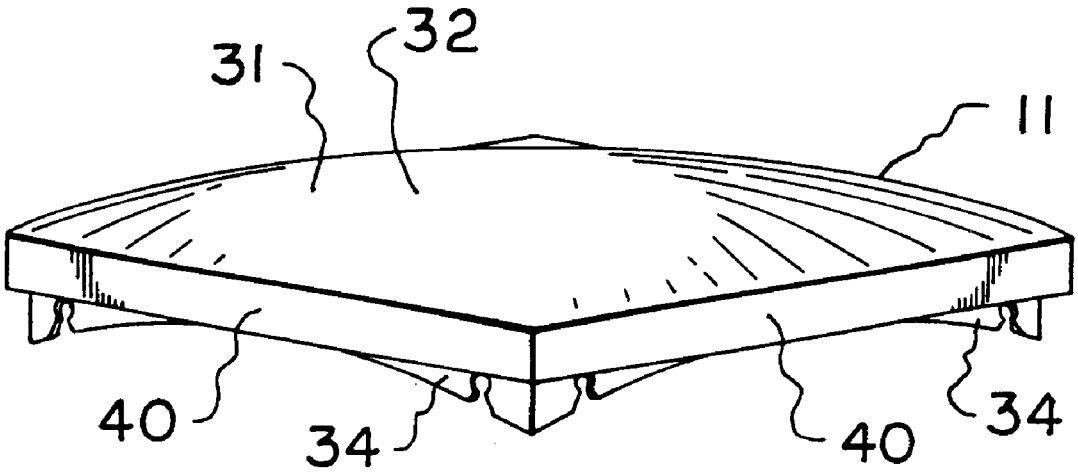
FIG. 17 is a perspective view of a tile showing especially the upper surface which is convex from its midpoint.

It is also to be noted from FIG. 4 that end pins 23 of each installed adjacent channel 12 are spaced apart the same distance M as the pairs of the closest pins 23 on the central portion of channel 12. Therefore, an assembly of a plurality of channels 12 in end-to-end relationship will be the equivalent of a single elongated channel. According to the geometry and dimensions of the channels 12 and tiles 11, as expressed in the table set forth hereafter, the spaces 47 (FIG. 1) between adjacent tiles will be approximately ⅛" which in turn permits drainage from the surfaces of the tiles into the spaces 47 (FIG. 9) between the adjacent tiles 11. The drainage is enhanced by the fact that the upper surface 32 of each tile plate 31 is slightly convex downwardly from its midpoint, as can be seen from FIG. 17.

Edge tiles 17 have the same outer dimensions and the same structure as inner tiles 11 except that their rib structure is slightly different. Therefore, where the same numerals are applied to edge tiles 17 which are applied to inner tiles 11, they will denote identical elements of structure, thereby obviating the necessity to describe the edge tiles in detail. The slightly different edge tile structure includes ribs 41' (FIG. 3) which are longer than ribs 41 between outer positioning members 40 and side members 34 (FIGS. 3 and 8). This dimensioning permits the positioning members 40 on the outer edges of the deck to lie only slightly inwardly of the leg 27 of channel 19 (FIGS. 8 and 10), thereby eliminating the necessity for trim at the outer edges of tiles 17. It can thus be seen that ribs 41' at the left and lower portions of FIG. 3 are longer than ribs 41. However, in order to maintain the dimensions D of the corner openings 47, ribs 35" have been moved closer to their adjacent parallel ribs 35' than the spacing between ribs 35' themselves which is identical to the spacing between ribs 35 of inner tile 11. Other than the foregoing, the edge tiles 17 are identical to inner tiles 11. The edge tiles 17 are locked in position in substantially the same manner as described above relative to inner tiles 11, namely, by pins 23 and 29 being locked into slots 43 and by outer side members 40 resting on channels 12 and 20.

Because of the outer dimensions of tiles 17 and the fact that the slots 43 in sides 34 are positioned identically to those described above relative to inner tile 11, the horizontal spaces 47 between edge tiles 17 in FIG. 1 will be the same as horizontal spaces 47 between the inner tiles 11. There will also be vertical spaces 49 (FIGS. 1 and 8) between the tiles in order to permit drainage from the convex top surfaces 31 of the tile plates 11 and 17 (FIG. 8). This drainage will be onto the tops of channels 12, and this drainage will either leak out along the sides of channels 12 or move to the intersections of spaces 47 and 49 and thereafter pass downwardly along the sides of channels 12. The spaces 47 and 49 will be approximately ⅛ inch. This spacing allows for expansion for the tiles 11 and 17 due to temperature changes. Also, if the tiles contract, they will still be supported by the outer side members 40 which rest on the channels. The above geometry is capable of achievement because of the dimensions set forth in the following representative table. However, it will be appreciated that other dimensions can be utilized to obtain comparable results.

| ITEM | DIMENSION IN INCHES |
|---|---|
| A | 16 |
| B | 15 ¼ |
| C | 15 ⅞ |
| D | 4 |
| E | 2 7/16 |
| F | 11 |
| G | 1 ½ |
| H | 15/16 |
| I | 1 ¾ |
| J | 48 |
| K | 2 ½ |
| L | 11 |
| M | 5 |
| N | 1 ½ |

It can be seen that because of the above described structure, there are only four parts required to construct a deck once the inner joists 13 and outer joists 15 and 20 have been built with the centers therebetween represented by dimensions A and B in the above table. These four parts are the inner channels 12, the outer channels 19, the inner tiles 11, and the edge tiles 17. Thus, the parts can be packaged for ease of shipping and handling. Furthermore, the channels 12 and 19 are conveniently fabricated in four foot lengths for ease of shipping and handling. In addition, as noted briefly above, the end pins on channels 12 and 19 are spaced such that when two channels are placed in end-to-end relationship, the spacing M therebetween is the same as the spacing M between the closest spaced pins on the central portions of the channels. In addition to the foregoing, there need be no specific orientation of the inner tiles 11 when they are being snapped into position, other than aligning their slots 43 with the pins 23 of the channels because the four sides of each tile 11 are identical. However, the edge tiles 17 have to be oriented with their outer positioning members 40, which are adjacent ribs 41', located at the extreme outer edge of the deck. If they are not oriented in this position, it will not be possible to install them because the side edges 34 adjacent ribs 41 will prevent the edge tiles 17 from entering the spaces between channels 12 and 19.

A preferred inner channel 60 is shown in FIG. 11. Channel 60 is an extrusion which has holes 61 drilled in the opposite legs 62. These holes are spaced apart the same amount as pins 23 of inner channel 12 (FIG. 4). In fact, the only difference between inner channel 12 of FIG. 4 and inner channel 60 of FIG. 11 is that the latter has holes 61 whereas the former has pins 23. Channel 60 is installed on inner joist 13 (FIG. 12) by inserting nails 63 through holes 61. The nails 63 are of slightly smaller diameter than holes 61. However, nails 63 have a diameter which is the same as the diameter of pins 23 so that they will be received in slots 43 of side members 34 in the same manner described above relative to pins 23. The nails 63 function as pins when they are received in slots 43. When inner channels 60 are used, there is no need to attach channels 62 to joists 13 by the use of nails which pass through the webs of the channels.

A preferred edge channel 64 is shown in FIG. 13. Edge channel 64 is an extrusion which is identical in all respects to edge channel 19 of FIG. 5 except that it only has holes 65 drilled in one side 67 thereof. Edge channel 64 is an extrusion. It is attached to edge joist 20 by driving nails 63 through holes 65. The nails 63 protrude from side 67, as shown, to receive slots 43 in side members 34 as described above relative to edge channels 19 (FIG. 5A). As noted above, holes 65 are drilled only into one leg 67.

In FIG. 15 the top surface of a tile 11*a* is shown. Tile 11*a* may be identical in all respects to tile 11 described above except that it has a wood grain finish 69 which has depth to both provide an anti-skid surface and a decorative finish. In FIG. 16 a tile 11*b* is shown which has a brick pattern finish 70 on its upper surface which is both anti-skid and decorative. It will be appreciated that any suitable designs can be embossed into the upper surfaces of the tiles.

Railing posts 50 (FIGS. 1 and 10) can be installed in the following manner. The portion of plate 31 having the dimension D at the corner of the tile 17 is cut out to provide an opening 47 and the post 50 is inserted therethrough. Thereafter, it is bolted into position by bolts 51 which pass through edge joists 20 and the lower portion of post 50. Additionally, a shim 52 is located between the bottom end of the post and joists 20. The thickness of this shim is equal to the combined thicknesses of channel leg 19 and side member 34.

The above description has referred to the tiles 11 and 17 as being made of a resin. In this respect high density polyethylene is preferred, but it will be appreciated that any other suitable resin including but not limited to polypropylene, polystyrene and polyvinylchloride may be used.

While the above description has been directed to a deck, it will be appreciated that the floor system can be used for animal pens, dock surfaces and platforms for air conditioners and garbage cans.

While preferred embodiments of the present invention have been disclosed, it will be appreciated that it is not limited thereto but may be otherwise embodied within the scope of the following claims.

What is claimed is:

1. A resin tile comprising a plate, upper and lower surfaces on said plate, a plurality of inner side members extending downwardly from said lower surface of said plate, a plurality of ribs positioned below said lower surface, outer edges on said ribs molded integrally with said inner side members, outer side members extending downwardly from said plate and located outwardly of said inner side members, said upper surface being convex, lower edges on said inner side members, and slots extending inwardly into certain of said inner side members from said lower edges.

2. A resin tile comprising a plate, upper and lower surfaces on said plate, a plurality of inner side members extending downwardly from said lower surface of said plate, a plurality of ribs positioned below said lower surface, outer edges on said ribs molded integrally with said inner side members, outer side members extending downwardly from said plate and located outwardly of said inner side members, lower edges on said inner side members, and slots extending inwardly into certain of said inner side members from said lower edges.

3. A resin tile comprising a plate, upper and lower surfaces on said plate, a plurality of inner side members extending downwardly from said lower surface of said plate, a plurality of ribs positioned below said lower surface, outer edges on said ribs molded integrally with said inner side members, outer side members extending downwardly from said plate and located outwardly of said inner side members, and said inner side members including portions of greater vertical height than said outer side members.

4. A resin tile as set forth in claim 3 wherein said upper surface is convex.

5. A resin tile as set forth in claim 4 including lower edges on said inner side members and slots extending inwardly into certain of said inner side members from said lower edges.

6. A resin tile as set forth in claim 3 including lower edges on said inner side members and slots extending inwardly into certain of said inner side members from said lower edges.

7. A resin tile as set forth in claim 3 wherein said plate has four edges of substantially equal dimensions.

8. A resin tile as set forth in claim 7 wherein said outer side members extend downwardly from said four edges.

9. A resin tile as set forth in claim 8 wherein said inner side members include portions of greater vertical height than said outer side members.

10. A resin tile as set forth in claim 9 including lower edges on said inner side members and slots extending inwardly into certain of said inner side members from said lower edges.

11. A resin tile as set forth in claim 10 wherein said ribs are molded into said lower surface, and second ribs molded between said inner and outer side members.

12. A resin tile as set forth in claim 11 wherein said ribs have central portions which are molded to each other.

13. A tile assembly including a plurality of tiles as set forth in claim 11 including a plurality of channel members positioned alongside certain of said inner side members of said plurality of tiles.

14. A tile assembly including a plurality of tiles as set forth in claim 13 wherein said outer side members rest on said channel members.

15. A tile assembly including a plurality of tiles as set forth in claim 14 including pins extending outwardly from said channel members, and slots in said inner side members receiving said pins.

16. A tile assembly including a plurality of tiles as set forth in claim 13, and a plurality of channel members positioned alongside certain of said inner side members of said plurality of tiles.

17. A tile assembly including a plurality of tiles as set forth in claim 16 wherein said outer side members rest on said channel members.

18. A resin tile comprising a plate, upper and lower surfaces on said plate, a plurality of inner side members extending downwardly from said lower surface of said plate, a plurality of ribs positioned below said lower surface, outer edges on said ribs molded integrally with said inner side members, outer, side members extending downwardly from said plate and located outwardly of said inner side members, said ribs being molded into said lower surface, and second ribs molded between said inner and outer side members.

19. A resin tile as set forth in claim 18 wherein said second ribs are also molded into said lower surface.

20. A resin tile as set forth in claim 18 wherein said ribs have central portions which are molded to each other.

21. A resin tile as set forth in claim 18 including lower edges on said inner side members and slots extending inwardly into certain of said inner side members from said lower edges.

22. A resin tile as set forth in claim 21 wherein said inner side members include portions of greater vertical height than said outer side members.

23. A resin tile as set forth in claim 22 wherein said upper surface is convex.

24. A resin tile as set forth in claim 18 wherein said upper surface is convex in two directions which are substantially perpendicular to each other.

25. A resin tile as set forth in claim 18 wherein said upper surface is convex.

26. A resin tile comprising a plate, upper and lower surfaces on said plate, a plurality of inner side members extending downwardly from said lower surface of said plate, a plurality of ribs positioned below said lower surface, outer edges on said ribs molded integrally with said inner side members, outer side members extending downwardly from said plate and located outwardly of said inner side members, a plurality of channel members positioned alongside certain of said inner side members of said plurality of tiles, said outer side members resting on said channel members, pins extending outwardly from said channel members, and slots in said inner side members receiving said pins.

27. A tile assembly including a plurality of tiles as set forth in claim 26 wherein said inner side members include portions of greater vertical height than said outer side members.

28. A tile assembly including a plurality of tiles as set forth in claim 27 wherein said slots are in said portions of greater vertical height.

29. A tile assembly as set forth in claim 28 wherein said upper surface is convex.

30. A tile assembly as set forth in claim 27 wherein said upper surface is convex.

31. A tile assembly as set forth in claim 28 wherein said ribs are molded into said lower surface, and second ribs molded between said inner and outer side members.

32. A tile assembly as set forth in claim 29 wherein said second ribs are also molded into said lower surface.

33. A tile assembly as set forth in claim 30 wherein said ribs have central portions which are molded to each other.

34. A resin tile comprising a plate, upper and lower surfaces on said plate, a plurality of inner side members extending downwardly from said lower surface of said plate, a plurality of ribs positioned below said lower surface, outer edges on said ribs molded integrally with said inner side members, outer side members extending downwardly from said plate and located outwardly of said inner side members, a plurality of channel members positioned alongside certain of said inner side members of said plurality of tiles, said channel members including a web and depending legs, and said channel members being mounted on joists with said webs adjacent the edges of said joists and said legs straddling said joists and with said outer side members engaging said webs.

35. A tile assembly including a plurality of tiles as set forth in claim 34 wherein said inner side members include portions of greater vertical height than said outer side members.

36. A tile assembly including a plurality of tiles as set forth in claim 35 including slots in said portions of greater vertical height.

37. A tile assembly including a plurality of tiles as set forth in claim 36 wherein said upper surfaces of said upper plates are convex.

38. A tile assembly including a plurality of tiles as set forth in claim 36 including pins extending outwardly from said depending legs which are received in said slots.

39. A tile assembly as set forth in claim 34 wherein said ribs are molded into said lower surface, and second ribs molded between said inner and outer side members.

40. A tile assembly as set forth in claim 39 wherein said second ribs are also molded into said lower surface.

41. A tile assembly as set forth in claim 39 wherein said ribs have central portions which are molded to each other.

42. A resin tile comprising a plate having an upper surface and a lower surface, a plurality of inner flanges extending downwardly from said plate, a plurality of outer flanges extending downwardly from said plate outwardly of said inner flanges, a plurality of first ribs extending between said inner flanges, and a plurality of second ribs extending between said inner and outer flanges.

43. A resin tile as set forth in claim 42 wherein said first ribs are molded integrally with said inner flanges and said lower surface, and wherein said second ribs are molded integrally with said inner and outer flanges and said lower surface.

44. A resin tile as set forth in claim 43 wherein said first ribs are also molded integrally with each other.

45. A resin tile as set forth in claim 44 wherein said inner flanges include portions of greater vertical height than said outer flanges.

46. A resin tile as set forth in claim 45 wherein said inner flanges have lower edges, and slots extending inwardly into said inner flanges from said lower edges.

47. A tile assembly including a plurality of tiles as set forth in claim 42 including a plurality of channel members each having legs and a web with said legs positioned alongside said inner flanges, and said outer flanges resting on said webs.

48. A tile assembly as set forth in claim 47 wherein said inner flanges have lower edges, slots extending inwardly into said inner flanges from said lower edges, and pins extending outwardly from said legs and received in said slots.

49. A tile assembly as set forth in claim 48 wherein said first ribs are molded integrally with said inner flanges and said lower surface, and wherein said second ribs are molded integrally with said inner and outer flanges and said lower surface.

50. A tile assembly as set forth in claim 49 wherein said first ribs are also molded integrally with each other.

51. A resin tile as set forth in claim 42 wherein said plate has four edges of substantially equal dimensions.

52. A resin tile as set forth in claim 51 wherein said outer flanges extend downwardly from said edges of said plates.

53. A resin tile as set forth in claim 42 wherein said upper surface is convex in two directions which are substantially perpendicular to each other.

54. A flooring system comprising resin channels having webs and legs mounted on joists with said webs resting on the edges of the joists and said legs straddling the sides of the joists, pins extending outwardly from said legs, a plurality of adjacent resin tiles each including a plate, inner flanges extending downwardly from said plates, slots in said inner flanges receiving said pins, and outer flanges located outwardly of said inner flanges and resting on said webs of said channels.

55. A flooring system as set forth in claim 54 wherein said pins comprise nails which are driven into said sides of said joists.

56. A flooring system as set forth in claim 55 wherein said legs of said channels include spaced holes, and wherein said nails extend through said spaced holes.

57. A flooring system as set forth in claim 54 wherein said pins are molded integrally with said legs of said channels.

58. A flooring system as set forth in claim 54 wherein said plates have four edges of substantially equal dimensions, and wherein said outer flanges extend downwardly from said edges of said plates.

59. A resin tile as set forth in claim 54 wherein each of said plates includes an upper surface which is convex in two directions which are substantially perpendicular to each other.

* * * * *

UNITED STATES PATENT AND TRADEMARK OFFICE

CERTIFICATE OF CORRECTION

PATENT NO. : 6,619,002 B2
DATED : September 16, 2003
INVENTOR(S) : Frederick M. Pettit It is certified that error appears in the above-identified patent and that said Letters Patent is hereby corrected as shown below:

Column 7,
Line 45, change "claim 13" to -- claim 3 --.

Column 8,
Line 34, change "claim 28" to -- claim 26 --.
Line 37, change "claim 29" to -- claim 31 --.
Line 39, change "claim 30" to -- claim 32 --.

Column 9,
Line 22, change "claim 44" to -- claim 42 --.

Signed and Sealed this

Sixteenth Day of December, 2003

JAMES E. ROGAN
*Director of the United States Patent and Trademark Office*